US005407287A

United States Patent [19]

Braun et al.

[11] Patent Number: 5,407,287

[45] Date of Patent: Apr. 18, 1995

[54] TOOTHBRUSH WITH SELF-CONTAINED TOOTHPASTE DISPENSER

[75] Inventors: John C. Braun, Rte. 12, Box 425-B, Meridian, Miss. 39305; William Jones; Thomas C. Hill, both of Starkville, Miss.

[73] Assignee: John C. Braun, Meridian, Miss.

[21] Appl. No.: 591,274

[22] Filed: Oct. 1, 1990

[51] Int. Cl.[6] ..... B05C 17/015; A46B 11/02; A45D 40/26

[52] U.S. Cl. ..... 401/176; 401/188 R; 401/190; 401/271; 401/280

[58] Field of Search ..... 401/176, 180, 190, 271, 401/278–280, 157, 187, 188 R, 206; 251/321, 326

[56] References Cited

U.S. PATENT DOCUMENTS

| | | | |
|---|---|---|---|
| 995,626 | 6/1911 | Moran . | |
| 1,085,839 | 2/1914 | Acton | 401/279 |
| 1,134,865 | 4/1915 | Jones | 401/180 X |
| 1,258,677 | 3/1918 | Haskell | 401/180 X |
| 1,653,987 | 12/1927 | Cliffe . | |
| 1,937,006 | 11/1933 | Aronson | 401/176 |
| 2,226,663 | 12/1940 | Hill et al. . | |
| 2,416,684 | 3/1947 | Fischer . | |
| 2,441,520 | 5/1948 | Ulvick . | |
| 2,527,317 | 10/1950 | Magann et al. | 401/279 |
| 2,625,302 | 1/1953 | Mahoney | 401/180 X |
| 2,652,949 | 9/1953 | Martin | 401/279 X |
| 2,790,190 | 4/1957 | Mastrandrea | 401/190 X |
| 2,987,743 | 6/1961 | Capps . | |
| 3,256,894 | 6/1966 | Sherman | 401/188 R |
| 3,367,545 | 2/1968 | Cook | 401/190 X |
| 3,375,056 | 3/1968 | Rosan | 401/186 |
| 3,854,826 | 12/1974 | Adams | 401/188 R |
| 3,937,235 | 2/1976 | Broughton . | |
| 3,995,648 | 12/1976 | Kuryla . | |
| 3,997,273 | 12/1976 | Germann | 401/190 |
| 4,269,207 | 5/1981 | Konrad et al. . | |
| 4,530,369 | 7/1985 | Adams . | |
| 4,693,622 | 9/1987 | Booth . | |
| 4,695,177 | 9/1987 | Kuo . | |

FOREIGN PATENT DOCUMENTS

| | | | |
|---|---|---|---|
| 2600513 | 12/1987 | France | 401/188 |
| 2343421 | 3/1975 | Germany | 401/190 |
| 913371 | 12/1962 | United Kingdom | 401/188 |

*Primary Examiner*—Danton D. DeMille

[57] ABSTRACT

A fountain toothbrush has in its handle a toothpaste reservoir constantly pressurized by a charge of actuator gas acting through a cup-like piston disposed at the upstream end of the reservoir. The gas pressure pushes the piston and toothpaste downstream while resiliently urging the piston sidewall against the reservoir boundary wall to forwardly extrude toothpaste adjacent the boundary wall. A valve for selectively passing toothpaste from the reservoir to the brush head includes an apertured gate and a structurally separate actuator for translating the gate in a valve chamber in opposition to a bias spring. Separating the gate from the actuator permits the gate to be positively sealed against the chamber outlet by the toothpaste in the closed valve position. A lengthwise segment of the gate has a reduced thickness dimension so as not to fill the upstream side of the valve chamber, thereby avoiding the creation of a partial vacuum that would otherwise hold the gate in its open position.

11 Claims, 2 Drawing Sheets

TOOTHBRUSH WITH SELF-CONTAINED TOOTHPASTE DISPENSER

BACKGROUND OF THE INVENTION

1. Technical Field

The present invention relates to fountain toothbrushes having a built-in toothpaste reservoir and dispenser and, more particularly, to such fountain toothbrushes wherein the toothpaste is maintained under constant pressure so as to be selectively dispensed in response to actuation of a valve.

2. Discussion Of The Prior Art

It is well-known in the prior art to provide a toothbrush having a handle in the form of a reservoir for toothpaste that may be selectively dispensed. Such toothbrushes tend to fall into two categories, namely: those in which the toothpaste is normally not under pressure but is selectively pressurized to dispense the paste; and those in which the paste is under constant pressure and is dispensed by actuation of a valve. The former category is exemplified by the following patents: U.S. Pat. No. 2,226,663 (Hill et al); U.S. Pat. No. 995,626 (Moran); U.S. Pat. No. 4,693,622 (Booth); U.S. Pat. No. 3,995,648 (Kuryla); U.S. Pat. No. 4,269,207 (Konrad et al); U.S. Pat. No. 4,530,369 (Adams); U.S. Pat. No. 1,653,987 (Cliffe); U.S. Pat. No. 2,416,684 (Fischer); U.S. Pat. No. 2,441,520 (Ulvick); and U.S. Pat. No. 4,695,177 (Kuo). These pump-type devices all suffer from the disadvantage of inefficient evacuation of the paste reservoir, thereby resulting in significant amounts of wasted paste that cannot be pumped from the reservoir. In addition, the pump-type units usually require two hands to operate and thereby are no more convenient in use than a toothpaste tube and a separate brush.

Examples of toothbrushes with continuously pressurized paste reservoirs are found in U.S. Pat. Nos. 3,937,235 (Broughton) and U.S. Pat. No. 2,987,743 (Capps). In the Broughton patent the reservoir is pressurized by means of a plastic bag containing freon gas under pressure, the gas expanding the bag to pressurize the surrounding paste as the paste is dispensed. This arrangement is inefficient because the plastic bag tends to rollingly expand over some of the paste, trapping the paste against the reservoir wall and preventing it from being dispensed. The Capps patent discloses a reservoir wherein the paste is mixed with freon gas under pressure in the reservoir so that the gas and paste are dispensed together in response to actuation of a valve. The mixing of the gas and paste adds significantly to manufacturing time and cost. Moreover, the gas tends to discharge from the mixture before all of the paste is dispensed, thereby leaving a considerable amount of wasted paste in the reservoir. The Capps valving mechanism is somewhat easier to operate than the Broughton valve but requires that a spring be disposed directly in a toothpaste flow path with the result that the paste tends to collect on the spring and clog the dispensing path. In addition, actuation of the valve to dispense the toothpaste in the Capps arrangement requires movement of the toothpaste head relative to the reservoir/handle. This movement is not easily effected and, in any event, requires the use of both hands. The Capps valving mechanism itself requires a relatively complex set of parts, thereby adding to the overall manufacturing cost of the device. The cost of the product is also increased by the cost of the freon gas employed as the paste pressuring agent. Additionally, the possibility of the freon gas contaminating the toothpaste renders the Capps arrangement somewhat less than desirable.

OBJECT AND SUMMARY OF THE INVENTION

It is a primary object of the present invention to provide a method and apparatus for dispensing toothpaste to a brush from a reservoir in the brush handle whereby substantially all of the stored paste can be dispensed and wherein the dispensing actuator mechanism is both structurally and operationally simple.

It is another object of the present invention to provide a fountain toothbrush that is inexpensive to manufacture and can therefore be sold at a sufficiently low price to be disposable.

It is further object of the present invention to provide a unique valve structure for permitting selective dispensing of paste-like material from the reservoir.

Yet another object of the present invention is to provide an improved method and apparatus for continuously pressurizing toothpaste in a reservoir contained in a toothpaste handle.

In accordance with the present invention, and elongate reservoir disposed in a toothbrush handle has a cup-like piston initially disposed proximate the upstream end of the reservoir with the open side of the piston cup facing upstream or away from the paste. The piston periphery is contoured to match the interior boundary wall of the reservoir and provides a pressure seal between the downstream toothpaste and pressurized gas filling the upstream space. As toothpaste is dispensed from the downstream end of the reservoir, the pressurized gas causes the piston to move axially toward the downstream end. The pressurized gas maintains the sides of the piston cup in contact with the reservoir boundary wall causing the piston to push even the toothpaste disposed adjacent the reservoir wall in a downstream direction so that no wasted paste remains in the reservoir.

The actuator mechanism for the assembly includes a valve chamber in which a contoured gate member is slidable in a direction transverse to the flow path for the toothpaste. A spring, disposed out of the paste flow path, biases the gate to a position in the chamber wherein a flow aperture through the gate is out of alignment with the reservoir and outlet path. A push-button actuator on the handle is selectively actuable to translate the gate through the chamber in opposition to the spring bias, thereby positioning the gate aperture between the reservoir and outlet path and permitting toothpaste to flow to the toothbrush portion of the assembly. The gate and actuator are separate elements so that the gate can be forced flush against and positively seal the downstream opening of the valve chamber in the closed valve position. A slot or otherwise configured reduced thickness portion of the gate on its upstream surface prevents the gate from creating a partial vacuum in the valve chamber that would prevent the gate from freely moving.

The outflow passage to the bristle area of the brush maybe provided with a flexible orifice to limit exposure of the toothpaste to ambient air. Specifically, toothpaste, when exposed to air, tends to harden and clog outflow openings. The flexible orifice presents a small opening when not in use. Upon operation, the pressurized toothpaste expands that opening and drives the relatively small amount of hardened paste out of the assembly.

BRIEF DESCRIPTION OF THE DRAWINGS

The above and still further object, features and advantages of the present invention will become apparent upon consideration of the following detailed description of specific embodiments thereof, especially when taken in conjunction with the accompanying drawings wherein like reference numerals in the various figures are utilized to designate like components, and wherein.

DESCRIPTION OF THE PREFERRED EMBODIMENTS

Figures 1, 2, 3, 4, 5:
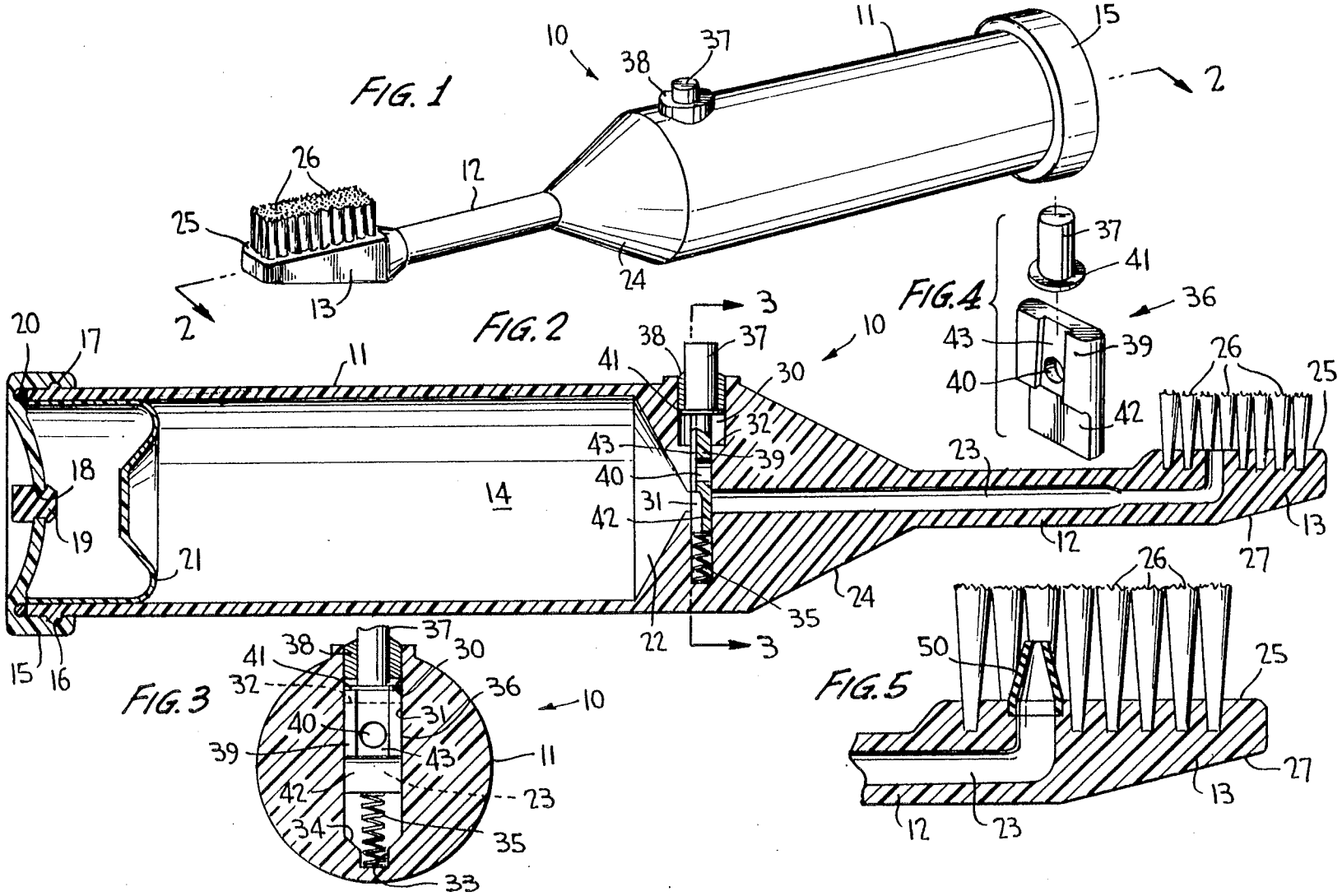
FIG. 1 is a view with perspective of a fountain toothbrush constructed in accordance with the present invention.
FIG. 2 is a view in longitudinal section taken along lines 2—2 of FIG. 1.
FIG. 3 is a view in transverse section taken along lines 3—3 of FIG. 2 and showing the valving arrangement of the present invention.
FIG. 4 is a view in perspective of the gate and actuator members of the valving arrangement.
FIG. 5 is a detailed view in longitudinal section of the head portion of a modified form of the fountain toothbrush of the present invention.

Referring specifically to FIGS. 1–4 of the accompanying drawings, a fountain toothbrush assembly 10 constructed pursuant to the present invention includes a handle 11 at one end, a head 13 at the opposite end and a stem 12 disposed between the handle and head. Handle 11 has a hollow interior chamber serving as a reservoir 14 for toothpaste, gel or other dentifrice. It is to be understood that, although the invention is described in connection with storing and dispensing toothpaste, suitable dentifrice gels, liquids and the like may also be employed without departing from the spirit of the invention. In the preferred embodiment reservoir 14 is cylindrical throughout the major part of its length, although any of a variety of different configurations maybe employed within the scope of the present invention. Likewise, the exterior configuration of handle 11 is primarily cylindrical. The interior wall of handle 11 defining reservoir 14 has a constant diameter and cross-section throughout the cylindrical length of the reservoir.

A cap 15 is secured to and seals reservoir 14 at the open proximal or upstream end of the cylindrical handle 11. Cap 15 is a generally cup-shaped member with an exteriorly concave base and a short cylindrical sidewall having an interior diameter that closely fits over the outside wall of handle 11 at the proximal handle end. To retain cap 15 on handle 11 there is an annular recess 16 formed in the interior surface of the cap sidewall. Recess 16 is contoured to receive an annular projection 17 from handle 11 in snap-fit engagement. The arcuate base of cap 15 projects a short distance into the handle interior and is provided with a central aperture 18 into which an elastomeric plug 19 is stuffed in pressure-sealing engagement. Additional pressure sealing between cap 15 and handle 11 is provided by an annular gasket 20 disposed in an annular recess defined in the base of the cap 15 to bear against the annular proximal edge of handle 11 when cap 15 is properly secured to the handle in the manner illustrated in FIG. 2.

A cup-like piston 21 is disposed within handle 11 symmetrically about the longitudinal axis of reservoir 14. The open-end of piston 21 faces cap 15, while the cylindrical cap sidewall bears against the cylindrical interior wall of the reservoir 14. The forward end of piston 21 is closed so that the reservoir volumes on opposite sides of the piston are pressure-isolated from one another. The downstream or forward end of reservoir 14 is a frusto-conically tapered section 22 having a downstream termination at the upstream end of an outflow passage 23 that extends through stem 12.

Stem 12 is a generally cylindrical section of smaller diameter than handle 11 and disposed coaxially with the handle. The transition between the larger diameter handle 11 and smaller diameter stem 12 is provided by a frusto-conical tapered section 24. Outflow passage 23 extends from downstream reservoir section 22 coaxially through the interiors of tapered section 24 and stem 12 to the head 13 where passage 23 bends at a right angle to terminate at a bristle-retaining surface 25. Multiple bristle-retaining recesses are defined in surface 25 and receive respective bristle tufts 26 secured in the recesses by a suitable adhesive. The bristle-retaining recesses are disposed in an ordered array that is interrupted only by the egress opening of outflow passage 23 at surface 25.

The surface 27 of head 13 opposite bristle-retaining surface 25 is tapered or otherwise contoured as desired to facilitate efficient movement of the brush in the mouth of a user. In this regard, the arrangement of bristles 26 and the size of head 13 may be selected as desired to provide efficient brushing movements. Likewise, stem 12, and passage 23 therein, maybe bent to orient head 13 at an angle relative to the handle axis as is provided in some toothbrush designs.

A valve arrangement is provided to permit selective control over the flow of toothpaste from reservoir 14 to the bristles 26 via outflow passage 23. The valve arrangement includes a cylindrical bore extending radially inward from the external surface of handle 11 at a location adjacent the rearward end of tapered section 24. A longitudinal axis of cylindrical bore 30 intersects the longitudinal axis of outflow passage 23; however, the depth of bore 30 into the handle is insufficient for the bore to reach passage 23. Rather, a bore 31 of generally elliptical cross-section extends coaxially from bore 30, intersecting outflow passage 23 and extending radially through the handle beyond that passage. The major or long dimension of the cross-section of bore 31 is substantially equal to the diameter of cylindrical bore 30, and the larger sides of the approximately elliptical cross-section are substantially flat. The major dimension of the cross-section of bore 31 is disposed transversely of the longitudinal axis of outflow passage 23. The minor or smaller dimension of the cross-section of bore 31 is substantially smaller than the diameter of cylindrical bore 30 and is disposed parallel to the axis of outflow passage 23. The transition between bores 30 and 31 takes the form of a shoulder 32 disposed in a plane parallel to the axis of passage 23. At the bottom of bore 31 there is a short cylindrical bore 33 having a diameter substantially equal to the minor or smaller diameter of bore 31 and disposed coaxially with larger cylindrical bore 30. Bore 33 is closed at its end opposite bore 31. The major or longer dimension of bore 31 may include a tapered section 34 serving as a gradual transition between bores 31 and 33; alternatively, this transition maybe a generally elliptical shoulder. Bores 30, 31, and 33 constitute a valve chamber.

Within the valve chamber 30, 31 and 33 there is a spring 35, a gate 36, an actuator 37 and an actuator retainer 38. Spring 35 is a helical compression spring having one end positioned to abut the closed end of bore 33, its other end extending into bore 31 in a radial direction with respect to handle 11. The particular type of spring is not a critical feature of the invention so that, for example, the spring may be of the resilient wishbone type wherein the spring legs bias the gate toward the closed valve position. Gate 36 has one end abutting the end of spring 35 disposed within bore 31. The other end of gate 36 projects into bore 30 wherein it abuts one end of actuator 37. The actuator is retained in bore 30 by retainer 38 secured in place in the opening for bore 30 at the external surface of handle 11.

Gate 36 is subdivided into two segments, namely: a relatively thick segment 39 abutting actuator 37; and a thinner segment 42 abutting spring 35. Thicker segment 39, except for a longitudinally extending pressure relief slot 43 recessed into its upstream facing surface, has a peripheral contour matching, but slightly smaller than, the cross-section of generally elliptical bore 31, thereby permitting the gate to freely slide within bore 31. Slot 43 extends along the entire length of gate segment 39 at a relatively shallow depth into the thickness or minor dimension of the segment. A circular gate aperture 40 is defined through the minor dimension of gate segment 39 at slot 43 and has a diameter that is preferably slightly smaller than the diameter of outflow passage 23 at the point where passage 23 is intersected by bore 31. The thinner gate segment 42 is thinner than segment 39 by virtue of having its entire upstream surface recessed to a greater extent than the recess at slot 43. Segment 42 has the same major dimension as segment 39. The transition between gate segments 39 and 42 may be a gradual taper; alternatively, the transition may be a sudden step.

The purpose of slot 43 is to provide a flow path for toothpaste between the valve chamber volumes above and below gate 36 on the high pressure side of the gate. In the absence of such a slot, gate 36 may sometimes move more slowly than desired when returning from its actuated position to its closed position under the influence of spring 35. More particularly, toothpaste trapped in the chamber at the actuator end of the gate, and a partial vacuum created in the chamber at the spring end of the gate, combine to oppose gate movement. Slot 43 permits the pressurized toothpaste to flow into the chamber volume at the spring end of the gate to thereby equalize the pressure created across the gate by the toothpaste and permit the spring to quickly force the gate to its closed position.

Slot 43 also increases the upstream facing surface area upon which the pressurized toothpaste acts to enhance the sealing forces urging the gate into pressure-sealing contact with the downstream wall of the chamber.

Actuator 37 is a separate element having a cylindrical configuration with a widened base in the form of an annular flange 41 bearing against the end of segment 39 of gate 36. Retainer 38 is an annular member engaged by force fit, adhesive, or the like, in bore 30. A central aperture in retainer 38 receives actuator 37 in sliding engagement so that an end of the actuator projects out of bore 30 beyond the surface of handle 11. Annular flange 41 is sufficiently wide to prevent actuator 37 from being readily pulled out of the retainer 38.

In the fully extended state of spring 35, gate 36 is positioned by the spring to align segment 42 with outflow passage 23. Gate aperture 40 is thereby positioned out of alignment with passage 23, and communication between reservoir 14 and passage 23 is blocked. In order to open the valve, actuator 37 is pushed through retainer 38 against the bias of spring 35 until gate aperture 40 is aligned with passage 23.

In preparing the fountain toothbrush assembly 10 for use, cap 15 and piston 21 are removed from the assembly and toothpaste is loaded into reservoir 14 from the open upstream end of handle 11. The volume of toothpaste placed in the reservoir should be such that, with the valve arrangement closed, the paste will be tightly packed and pressurized after piston 21 is in place at the upstream end of the reservoir. The piston is then forced into the upstream end and cap 15 is snapped into place to seal the interior volume. Pressurized air or other actuator gas is then injected, by means of a hypodermic needle or the like, through the elastomeric plug 19 in order to pressurize the interior space on the upstream side of piston 21. Of course, other known techniques maybe employed to charge the upstream space with actuating gas. For a reservoir volume of 2.93 cubic inches, the initial actuating gas pressure in the upstream space would typically be thirty psig for an initial volume 0.5 cubic inches. These values, however, are not to be construed as limiting the scope of the present invention. The assembly, thusly charged with toothpaste under pressure from an actuating gas, is ready for use.

Initially, prior to valve actuation and actual use, it is to be noted that the pressurized toothpaste forces segment 42 of gate 36 against the downstream opening from the valve chamber to the outflow passage 23. An effective seal between the reservoir 14 and the downstream portion of passage 23 is achieved by making gate 36 a separate element from actuator 37. Specifically, there can be no pivoting or skewing of the gate and actuator about an axis transverse to flow, which skewing might tend to prevent flush positioning of the downstream side of gate section 42 against the opening to passage 23. The structural separation of actuator 37 from gate 36, therefore, assures a proper seal when the valve is closed.

In order to dispense toothpaste from reservoir 14 to the bristles 26 at head 13, push-button actuator 37 is depressed radially into the handle body by the thumb or other finger of the user. This movement of the actuator 37 is effected against the bias force of spring 35. The spring is thereby axially compressed as gate 36 and actuator 37 move in the valve chamber radially with respect to the longitudinal axis of passage 23. When any portion of gate aperture 40 is aligned with passage 23, pressurized toothpaste from reservoir 14 is forced through the now open valve and passage 23 to the bristles 26. By controlling the extent of depression of push-button actuator 37, the area of gate aperture 40 aligned with passage 23 may be selectively controlled. Accordingly, the size of the valve opening can be controlled to thereby control the flow rate of toothpaste to the bristles.

As toothpaste is dispensed from reservoir 14, the piston 21, under the pressure of the actuating gas filling its upstream interior space, moves downstream. The pressurized actuating gas expands to fill the increasing volume of this upstream space. The actuating gas pressure acts in all directions in the upstream space to maintain the annular wall of the piston 21 in flush contact with the boundary wall of the reservoir to assure that toothpaste disposed along the boundary wall cannot become trapped between the piston and the wall but instead is extruded or pushed downstream and eventually dispensed. In this regard, the piston sidewall, although essentially rigid, is sufficiently resiliently expandable to permit it to be forced against the reservoir boundary wall. It will therefore be appreciated that the shape of the piston sidewall must match the shape of the reservoir boundary wall, whether that shape be of circular cross-section as shown in the drawings or any other desired cross-section.

As the space upstream of piston 21 expands due to the dispensing of toothpaste from the reservoir, the pressure of the actuating gas necessarily decreases. Therefore, it is important that the initial gas pressure be selected to assure that the final pressure is sufficiently high to force toothpaste through the open valve and passage 23. For a reservoir having a total volume of 2.93 cubic inches of which 0.5 cubic inches are initially disposed upstream of the piston, an initial gas pressure of thirty psig results in a final gas pressure of five psig when the piston has been translated to its extreme downstream position. This final gas pressure is sufficient to effect dispensing of the toothpaste.

Slot 43 combines with reduced thickness segment 42 of gate 36 to prevent the gate from becoming stuck in the open valve position in the manner described above. Specifically, in the absence of slot 43, segment 39 would transversely fill the generally elliptical bore portion of the valve chamber. During actuation of such a gate, air or toothpaste in bore 33 and the adjacent portion of bore 31 would resist movement of the gate but would eventually be forced around the sides of the gate to permit valve actuation. However, once such a gate is fully actuated, a partial vacuum would be created in the lower (as viewed in FIGS. 2 and 3) part of the valve chamber to thereby resist return of the gate to its closed position under the force of spring 35. The toothpaste surrounding the valve chamber would prevent any air or toothpaste that might be in or near the upper part of the chamber from leaking around the gate body to fill the partial vacuum, and the gate would tend to be held by the partial vacuum in the open position. Slot 43 and the reduced thickness of gate segment 42, on the other hand, prevent creation of a partial vacuum by permitting toothpaste from reservoir 14 to enter the lower part of the valve chamber when the valve is open.

It is to be understood that the cup-like piston 21, pressurized by gas on its upstream side, and the floating valve 36 constitute a novel arrangement for continuously pressurizing and selectively dispensing a viscous medium, such as toothpaste. Although the valve arrangement disclosed herein is particularly advantageous when combined with the gas-driven cup-like piston, the latter will nevertheless function to advantage with other types of valves. Likewise, the unique valve structure disclosed herein may be employed in connection with any suitable technique for pressurizing the toothpaste and is not limited to the gas-driven cup-like piston.

The valve and piston disclosed herein may be utilized in systems other than fountain toothbrushes to dispense liquid or viscous materials.

Toothbrush assembly 10 is preferably manufactured as a disposable unit whereby the entire assembly would be disposed of after the toothpaste has been dispensed. Alternatively, it maybe desirable to fabricate the assembly so that reservoir 14 can be refilled with toothpaste and charged with pressurized actuation gas upstream of the piston.

By way of example only, and not to be construed as limiting on the scope of the present invention, the following is a list of dimensions and parameters for an operational embodiment of the present invention: outside diameter of cylindrical handle 11—1.2 inches; inside diameter of handle 11—1.063 inches; axial length of reservoir 14—3.3 inches (not including tapered space 22); axial length of tapered end 22—0.0175 inches; length of section of passage 23 upstream of valve chamber—0.075 inches; diameter of passage 23 immediately downstream of valve chamber—0.188 inches; diameter of reduced thickness section of passage 23—0.125 inches; length of passage 23 between valve chamber and reduced thickness of passage—1.90 inches; total length of handle 11, section 24, stem 12 and head 13—7.00 inches; diameter of bore 30—0.400 inches; axial length of bore 30—0.25 inches; major dimension of cross-section of bore 31—0.400 inches; minor dimension of cross-section of bore 31—0.205 inches; axial length of bore 31—0.750 inches; diameter of bore 33—0.200 inches; axial length of bore—0.158 inches; major dimension of cross-section of gate sections 39 and 42—0.395 inches; minor dimension of cross-section of gate section 39—0.200 inches; height of gate section 39—0.229 inches; minor dimension of cross-section of gate section 42—0.133 inches; diameter of gate aperture 40—0.125 inches; diameter of actuator 37—0.197 inches; diametric thickness of flange 41—0.200 inches; length of actuator 37, including flange 41—0.475 inches; outside diameter of retainer 38—0.402 inches; inside diameter of retainer 38—0.225 inches; axial length of retainer 38—0.250 inches; outside diameter of piston 21—1.063 inches; inside diameter of piston 21—1.033 inches; axial length of piston 21—0.707 inches; taper of annular sidewall of piston 21 in downstream direction—1.0°; volume of piston interior—0.5 cubic inches.

The materials employed for assembly 10 can vary considerably while still permitting the assembly to operate as intended. By way of example, the handle 11, tapered section 24, stem 12 and head 13 may be an integral molded member of Delrin 900 HT; piston 21, actuator 37 and gate 36 may be UHMW Teflon; end cap 15 and retainer 38 may also be Delrin 900 HT; and plug 19 may be thirty durometer neoprene.

There is a tendency for toothpaste to harden or "cake" when exposed to air because of evaporation of water from the paste. This hardening would occur at the egress opening of outflow passage 23 at surface 25 if assembly 10 is not used for a few days. The hardened paste tends to block the egress of paste being dispensed. One way to solve this problem would be to increase the gas pressure sufficiently upstream of piston 21 to force the "caked" toothpaste through the egress opening. Another approach to solving the problem is illustrated in FIG. 5 to which specific reference is now made. A flexible orifice in the form of a frusto-conical member 50 is disposed about the egress opening of passage 23 at surface 25 and projects from that surface with a decreasing diameter. The material employed for member 50 may be rubber or other suitable elastomer material of small thickness so as to be capable of permitting its raised egress opening to expand as the pressurized toothpaste flows therethrough. When toothpaste is not being dispensed, the egress orifice contracts to present a relatively small opening exposed to air. The toothpaste may tend to harden at the small opening, but the hardened material is quickly cleared during the next dispensing operation as the orifice widens in response to the pressurized toothpaste. Other forms of flexible openings may be employed to effect the function described. For example, the opening of passage 23 at surface 25 may be covered with a flat piece of elastomeric material secured to the brush head only at a portion of its periphery to serve as a flapper valve.

Figure 6:
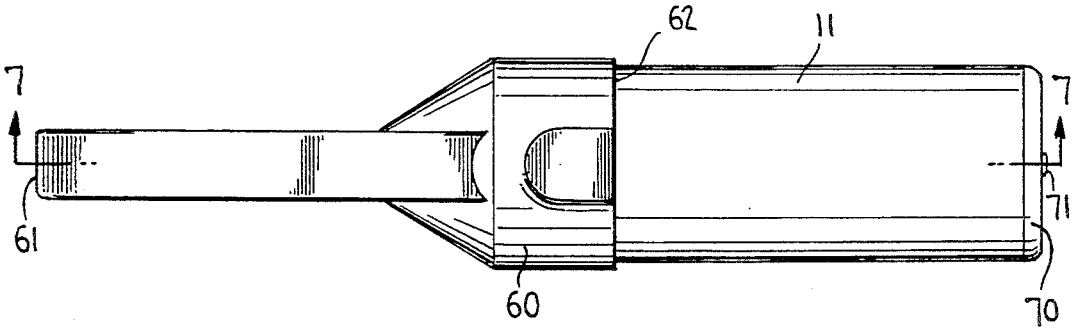
FIG. 6 is a side view in plan of an alternative fountain toothbrush embodiment of the present invention.
Figure 7:
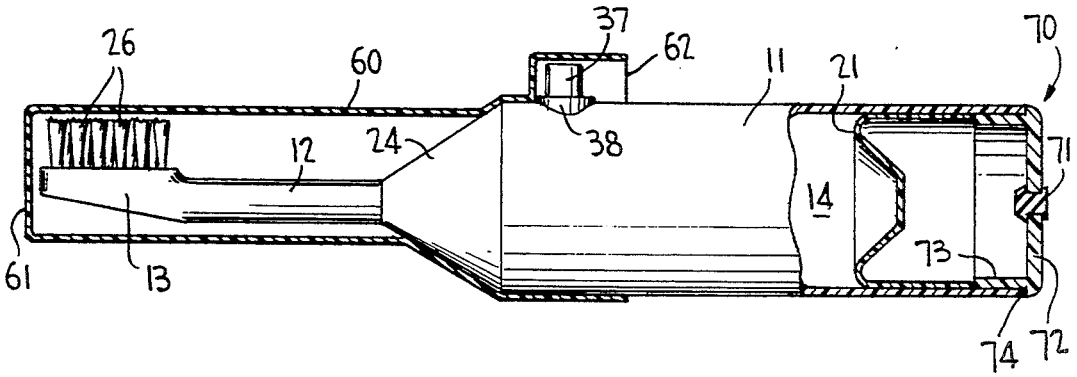
FIG. 7 is a view in longitudinal section taken along lines 7—7 of FIG. 6.

Other modifications for the fountain toothbrush of the present invention are illustrated in FIGS. 6 and 7 to which specific reference is now made. The fountain toothbrush is provided with a snap-on type cover 60 in the form of an elongated hollow member closed at one end 61 and open at the other end 62. Cover 60 is contoured to receive the head 13, stem 12, tapered section 24 and part of handle 11 including actuator 37. The material from which cover 60 is fabricated is sufficiently flexible to permit the cover to resiliently engage handle 11 when the cover is positioned on the unit. Cover 60 keeps the bristles clean, eliminates inadvertent actuation of actuator 37 and prevents the wet bristles 26 from contacting and wetting other items in a suitcase, or the like.

The embodiment of FIGS. 6 and 7 also includes a modified end cap 70. End cap 70 is provided with a flat, rather than concave, base 72 having a central access aperture sealed by an elastomeric plug 71 through which pressurized actuating gas may be delivered to the unit. The diameter of base 72 is substantially equal to the outside diameter of handle 11. Projecting from the interior surface of base 72 is a hollow cylindrical section 73 disposed concentrically with handle 11 but spaced radially inward from the circumferential edge of base 72 so that the outside diameter of section 73 is substantially equal to the inside diameter of handle 11. The result is an annular outer lip 74 disposed at the periphery of base 72 and having a radial thickness substantially equal to the thickness of the wall of handle 11. Cylindrical section 73 thus extends a short axial distance into the handle and, along with lip 74, is glued to the handle to prevent removal of the end cap.

It is to be understood that, although the most efficient configuration for reservoir 14 and the periphery of piston 21 is cylindrical, other configurations may be employed without departing from the spirit and scope of the invention.

From the foregoing it will be appreciated that the invention makes available a novel fountain toothbrush assembly and a method for dispensing toothpaste to a toothbrush from a self-contained reservoir.

Having described preferred embodiments of a new and improved method and apparatus in accordance with the present invention, it is believed that modifications, variations and changes will be suggested to those skilled in the art in view of the teachings as set forth herein. It is therefore to be understood that all such variations, modifications and changes fall within the scope of the present invention as defined by the appended claims.

What is claimed is:

1. A fountain toothbrush comprising:

an elongated hollow handle containing a sealed interior reservoir with upstream and downstream ends and a boundary wall with a uniform transverse cross-section throughout its length;

a piston disposed for longitudinal displacement in said reservoir and defining upstream and downstream pressure-isolated spaces in the reservoir, said piston having an outer periphery contoured to match the uniform cross-section of said reservoir boundary wall, said downstream space being fully occupied with toothpaste, said upstream space being permanently fully occupied with gas trapped under sufficient pressure to continuously urge the piston in a downstream direction to thereby continuously pressurize the toothpaste occupying the downstream space;

a toothbrush head having multiple bristles secured thereto;

an outflow passage disposed between the downstream end of the reservoir and said head;

actuable valve means for selectively dispensing said pressurized toothpaste by alternatively blocking and permitting flow of toothpaste through said outflow passage;

wherein said piston is a cup-like member with an open end facing the upstream end of said reservoir, a closed end facing the downstream end of said reservoir and abutting said toothpaste, and a continuous sidewall abutting the boundary of said reservoir in flush contact, wherein the pressurized gas in said upstream space resiliently urges said continuous sidewall against the reservoir boundary wall as the piston is urged in a downstream direction; and a cap secured to said handle to seal the upstream end of said reservoir, said cap including an elastomeric member through which a hypodermic needle may be inserted to deliver said pressurized gas to said upstream space.

2. A fountain toothbrush comprising:

an elongated hollow handle containing a sealed interior reservoir with upstream and downstream ends and a boundary wall with a uniform transverse cross-section throughout its length;

a piston disposed for longitudinal displacement in said reservoir and defining upstream and downstream pressure-isolated spaces in the reservoir, said piston having an outer periphery contoured to match the uniform cross-section of said reservoir boundary wall, said downstream space being fully occupied with toothpaste, said upstream space being fully occupied with gas under sufficient pressure to urge the piston in a downstream direction to thereby pressurize the toothpaste occupying the downstream space;

a toothbrush head having multiple bristles secured thereto;

an outflow passage disposed between the downstream end of the reservoir and said head; and selectively actuable valve means for alternatively blocking and permitting flow of toothpaste through said outflow passage;

wherein said piston is a cup-like member with an open end facing the upstream end of said reservoir, a closed end facing the downstream end of said reservoir and abutting said toothpaste, and a continuous sidewall abutting the boundary of said reservoir in flush contact, wherein the pressurized gas in said upstream space resiliently urges said continuous sidewall against the reservoir boundary wall as the piston is urged in a downstream direction; and wherein said valve means comprises:

a valve chamber intersecting the said outflow passage and having a first depth dimension parallel said outflow passage, a first width dimension transverse to said outflow passage and a first length dimension transverse to said outflow passage and both said width and depth dimensions, said valve chamber having a downstream surface with a downstream opening to said outflow passage;

a gate disposed in said valve chamber for longitudinally slidable movement therein, said gate having a first length section with depth and width dimensions corresponding to the first depth and first width dimensions of said valve chamber to thereby permit said slidable movement, said first length section having an upstream facing slot recessed depthwise therein and extending lengthwise along the entire length of said first length section, said gate having a second length section with a width dimension equal to said first width dimension of said first length section and a depth dimension considerably reduced from the depth dimension of said first length section to thereby provide a gap in the valve chamber at the upstream side of said second section;

wherein said first length section has a gate aperture defined therethrough to permit toothpaste to pass through said valve chamber when the gate is positioned to align the gate aperture with said outflow passage;

bias means for normally positioning said gate in a closed position wherein said second length section is in alignment with said outflow passage to prevent flow of toothpaste therethrough;

actuator means for permitting selective longitudinally slidable movement of said gate in said valve chamber in opposition to said bias means to controllably align said gate aperture with said outflow passage;

whereby said slot in said first gate section prevents formation of a partial vacuum in said valve chamber by providing a flow path between appropriate ends of the gate;

wherein said actuator means and said gate are structurally separate members, whereby movement of said actuator along all dimensions but the length dimension of said valve chamber produces no corresponding movement of said gate, and wherein the second length section of said gate is forced by the pressurized toothpaste to be flush against said downstream surface of the valve chamber in the closed position of the gate.

3. The fountain toothbrush according to claim 2 wherein said actuator means and said gate are structurally separate members, whereby movement of said actuator along all dimensions but the length dimension of said valve chamber produces no corresponding movement of said gate, and wherein the second length section of said gate is forced by the pressurized toothpaste to be flush against said downstream surface of the valve chamber in the closed position of the gate.

4. The fountain toothbrush according to claim 3 wherein said valve chamber includes a first extension section for receiving said actuator means, said first extension section having a longer width dimension than said first width dimension, and wherein said actuator means includes a retainer positionally secured in said first extension section and an elongate push-button disposed in said retainer for slidable movement longitudinally of said valve chamber, said push-button extending into contact with said gate to permit longitudinal movement of the gate in response to longitudinal movement of the push-button.

5. The fountain toothbrush according to claim 4 wherein said bias means comprises a spring disposed in said chamber in contact with said second gate section to urge said gate toward said push-button, and wherein said push-button is disposed to bear against said first gate section.

6. A fountain toothbrush comprising:

an elongated hollow handle containing a sealed interior reservoir with upstream and downstream ends and a boundary wall with a uniform transverse cross-section throughout its length;

a piston disposed for longitudinal displacement in said reservoir and defining upstream and downstream pressure-isolated spaces in the reservoir, said piston having an outer periphery contoured to match the uniform cross-section of said reservoir boundary wall, said downstream space being fully occupied with toothpaste, said upstream space being fully occupied with gas under sufficient pressure to urge the piston in a downstream direction to thereby pressurize the toothpaste occupying the downstream space;

a toothbrush head having multiple bristles secured thereto;

an outflow passage disposed between the downstream end of the reservoir and said head; and selectively actuable valve means for alternatively blocking and permitting flow of toothpaste through said outflow passage;

wherein said valve means comprises:

a valve chamber intersecting the said outflow passage and having a first depth dimension parallel said outflow passage, a first width dimension transverse to said outflow passage and a first length dimension transverse to said outflow passage and both said width and depth dimensions, said valve chamber having a downstream surface with a downstream opening to said outflow passage;

a gate disposed in said valve chamber for longitudinally slidable movement therein, said gate having a first length section with depth and width dimensions corresponding to the first depth and first width dimensions of said valve chamber to thereby permit said slidable movement, said first length section having an upstream facing slot recessed depthwise therein and extending lengthwise along the entire length of said first length section, said gate having a second length section with a width dimension equal to said first width dimension of said first length section and a depth dimension considerably reduced from the depth dimension of said first length section to thereby provide a gap in the valve chamber at the upstream side of said second section;

wherein said first length section has a gate aperture defined therethrough to permit toothpaste to pass through said valve chamber when the gate is positioned therein to align the gate aperture with said outflow passage;

bias means for normally positioning said gate in a closed position wherein said second length section is in alignment with said outflow passage to permit flow of toothpaste therethrough:

actuator means for permitting selective longitudinally slidable movement of said gate in said valve chamber in opposition to said bias means to controllably align said gate aperture with said outflow passage;

whereby said slot in said first gate section prevents formation of a partial vacuum in said valve chamber by providing a flow path between appropriate ends of the gate.

7. The fountain toothbrush according to claim 6 wherein said actuator means and said gate are structurally separate members, whereby movement of said actuator along all dimensions but the length dimension of said valve chamber produces no corresponding movement of said gate, and wherein the second length section of said gate is forced by the pressurized toothpaste to be flush against said downstream surface of the valve chamber in the closed position of the gate.

8. The fountain toothbrush according to claim 7 wherein said valve chamber includes a first extension section for receiving said actuator means, said first extension section having a longer width dimension than said first width dimension, and wherein said actuator means includes a retainer positionally secured in said first extension section and an elongate push-button disposed in said retainer for slidable movement longitudinally of said valve chamber, said push-button extending into contact with said gate to permit longitudinal movement of the gate in response to longitudinal movement of the push-button.

9. The fountain toothbrush according to claim 8 wherein said bias means comprises a spring disposed in said chamber in contact with said second gate section to urge said gate toward said push-button, and wherein said push-button is disposed to bear against said first gate section.

10. The method of selectively dispensing toothpaste from a hollow handle to a toothbrush head via a passage disposed between and connected to said handle and said head, said method comprising the steps of:

(a) maintaining said toothpaste under continuous pressure by:

(a.1) subdividing said hollow handle into two pressure-isolated distal and proximal subchambers and disposing said toothpaste in said distal subchamber;

(a.2) permanently trapping gas under pressure greater than atmospheric pressure in said proximal subchamber by injecting the gas into the proximal subchamber through an elastomeric member penetrable by a hypodermic needle or the like; and (a.3) continuously urging a piston in a distal direction by means of the pressurized gas trapped in said proximal subchamber, wherein said piston prevents said pressurized gas from mixing with said toothpaste;

(b) alternatively blocking and passing flow of the continuously pressurized toothpaste to said passage from a distal end of said distal subchamber by means of a manually actuable valve interposed between said distal subchamber and said passage.

11. The method according to claim 10 wherein said valve includes a gate member having a gate opening therein and disposed in a valve chamber located between said distal subchamber and said passage and having a distal wall through which said passage is defined, wherein step (b) comprises the steps of:

(b.1) continuously forcing the gate member flush against the distal wall of the valve chamber by means of the pressurized toothpaste in said distal subchamber;

(b.2) positionally biasing said gate member to a position wherein the gate opening is completely misaligned with respect to said passage; and (b.3) selectively moving said gate member in opposition to said positional biasing to align said gate opening with said passage to permit toothpaste to flow through said valve opening and said passage to said head.

* * * * *